US010325769B2

(12) United States Patent
Kuepper et al.

(10) Patent No.: US 10,325,769 B2
(45) Date of Patent: Jun. 18, 2019

(54) GAS-DISCHARGE LAMP FOR A VEHICLE HEADLAMP

(71) Applicant: KONINKLIJKE PHILIPS N.V., Eindhoven (NL)

(72) Inventors: Lukas Kuepper, Aachen (DE); Hans-Alo Dohmen, Aachen (DE); Thorsten Erich Lenzen, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 15/533,643

(22) PCT Filed: Dec. 4, 2015

(86) PCT No.: PCT/EP2015/078658
§ 371 (c)(1),
(2) Date: Jun. 6, 2017

(87) PCT Pub. No.: WO2016/091748
PCT Pub. Date: Jun. 16, 2016

(65) Prior Publication Data

US 2017/0345638 A1 Nov. 30, 2017

(30) Foreign Application Priority Data

Dec. 12, 2014 (EP) ..... 14197534

(51) Int. Cl.
*H01J 5/08* (2006.01)
*F21V 7/04* (2006.01)
(Continued)

(52) U.S. Cl.
CPC ..... *H01J 61/025* (2013.01); *F21S 41/17* (2018.01); *F21S 41/43* (2018.01); *H01J 61/35* (2013.01); *H01J 61/54* (2013.01)

(58) Field of Classification Search
CPC ..... H01J 61/025; H01J 61/35; H01J 61/54; F21S 48/145; F21S 48/1186; H01K 1/32; H01K 1/325
See application file for complete search history.

(56) References Cited

U.S. PATENT DOCUMENTS 5,725,298 A 3/1998 Kalze et al.
5,955,846 A 9/1999 Kominami et al.
(Continued)

FOREIGN PATENT DOCUMENTS

CN 1160137 A 9/1997
EP 0002848 A1 7/1979
EP 0708978 B1 2/1998

OTHER PUBLICATIONS

Extended European Search Report dated Aug. 26, 2015, European Patent Application No. 14197534.2, 11 pages.
(Continued)

*Primary Examiner* — Nimeshkumar Patel
*Assistant Examiner* — Jacob R Stern

(57) ABSTRACT

The invention describes a gas-discharge lamp comprising an inner vessel enclosing a pair of electrodes separated by a gap; and an outer vessel enclosing the inner vessel; and wherein the lamp comprises a lateral stripe arranged on the surface of a vessel such that the lateral stripe lies below a horizontal plane through a longitudinal axis through the center of the lamp, and wherein the lateral stripe extends essentially only over a region corresponding to the gap between the electrodes.

12 Claims, 5 Drawing Sheets

(51) Int. Cl.

| | |
|---|---|
| ***H01J 61/02*** | (2006.01) |
| ***H01J 61/35*** | (2006.01) |
| ***H01J 61/54*** | (2006.01) |
| ***F21S 41/17*** | (2018.01) |
| ***F21S 41/43*** | (2018.01) |

(56) References Cited

U.S. PATENT DOCUMENTS

| | | | |
|---|---|---|---|
| 2002/0180358 | A1 | 12/2002 | Kobayakawa et al. |
| 2007/0029916 | A1 | 2/2007 | Hendricx |
| 2012/0119645 | A1 | 5/2012 | Boroczki et al. |
| 2013/0063949 | A1 | 3/2013 | Kuepper et al. |

OTHER PUBLICATIONS

EPO as ISA, "International Search Report and Written Opinion" dated Feb. 16, 2016 from International Application No. PCT/EP2015/078658, filed Dec. 4, 2015, 12 pages.

European Search Report dated May 22, 2015 from European Application No. 14197534.2 filed Dec. 12, 2014, 7 pages.

First Office Action dated Aug. 3, 2018, China Patent Application No. 201580067706.2, 13 pages.

GAS-DISCHARGE LAMP FOR A VEHICLE HEADLAMP

CROSS-REFERENCE TO RELATED APPLICATIONS

The present application is a § 371 application of International Application No. PCT/EP2015/078658 filed on Dec. 4, 2015 and entitled "GAS-DISCHARGE LAMP FOR A VEHICLE HEADLAMP," which claims the benefit of European Patent Application No. 14197534.2 filed on Dec. 12, 2014. International Application No. PCT/EP2015/078658 and European Patent Application No. 14197534.2 are incorporated herein.

FIELD OF THE INVENTION

The invention describes a gas discharge lamp.

BACKGROUND OF THE INVENTION

To ensure traffic safety and to facilitate trade, design and construction aspects, vehicle headlamps are specified by internationally recognized UN/ECE regulations. Generally, it is of critical importance that the front beam profile satisfies strict requirements, for example requirements relating to the shape of a bright/dark cut-off line, the maximum light intensity that is allowed above the bright/dark cut-off line, etc. Other characteristics such as color temperature, lamp driver characteristics, lamp dimensions, etc. are also governed by applicable regulations. High-intensity discharge lamps (HID lamps) such as Xenon HID lamps are widely used in automotive headlamp applications, since they can provide an intensely bright light.

There are basically two different types of vehicle headlamps for use with a HID bulb, namely a projector headlamp and a reflector headlamp. In a projector headlamp a so-called S-type HID bulb is used, and in a reflector headlamp a so-called R-type HID bulb is used. In a projector headlamp, the light from the S-type HID bulb (e.g. a D2S bulb, a D4S bulb etc.) is focused on a shield by an elliptical mirror. The non-shielded light is projected by a lens into the final beam pattern. In a reflector headlamp, an R-type HID bulb is placed horizontally in an essentially parabolic reflector, and the reflector images the discharge arc outward and onto the road. To prevent glare, the R-type HID bulb (e.g. a D2R lamp, a D4R lamp, etc.) has dedicated black "pinstripes" on its outer glass vessel to prevent glare and to obtain the required cut-off, see e.g. US20070029916A1 and US20130063949A1. Additionally the reflector headlamp uses a metal shield placed in front of the R-type HID bulb in order to block any scattered light that would either leave the headlamp directly (i.e. without undergoing any reflection) or would be scattered by the HID bulb itself (i.e. by its salt composition) in an uncontrolled way into the reflector and then leave the lamp in the direction of oncoming traffic. The opaque stripes on the outer HID bulb surface generally comprise a 'vertical' stripe, i.e. a stripe arranged around the circumference of the lamp near the lamp base, and 'horizontal' stripes arranged along the length of the lamp, which is mounted essentially horizontally in a reflector of a lighting assembly, as described in EP 0 708 978 B1. The stripes serve to block stray light which would otherwise contribute to excessive glare in the beam pattern. An S-type lamp for use in a projector headlamp does not have any stripes, since the projector itself eliminates the stray light by an internal shield and ensures that the glare values are reduced to satisfy the legal beam requirements.

Because the known HID lamps are specifically designed as either R-type or S-type, it is not possible to use an R-type lamp in an headlamp designed for use with an S-type lamp, since an acceptable beam pattern cannot be achieved if an R-type HID lamp is inserted into an S-type headlamp, and vice versa. For example, an S-type bulb in an R-type headlamp would result in glare levels which are not acceptable. On the other hand, using an R-type bulb in an S-type headlamp would reduce the beam length and width by up to 50%, which is clearly also not acceptable.

The driver of an automobile cannot be assumed to know which type of lamp is allowed for the vehicle headlamp, and it may be that a driver is not sure which choice of bulb is correct. Choosing the correct bulb is also difficult in the face of great variety of bulbs being manufactured by the various suppliers. This makes the overall situation complicated and confusing from the point of view of manufacturer, retailer and consumer.

Currently there are solutions on the market which offer a HID bulb without coatings and a metal shield which can be assembled or disassembled as required, depending on whether the lamp is to be used in a projection headlamp requiring an S-type lamp, or in a reflector headlamp requiring an R-type lamp. The metal shield is intended to fulfill the same function as pinstripes applied directly to the lamp. Due to the sophisticated mounting construction, the required precision, the high temperature load and the large size of the metal frame, such solutions are very expensive to manufacture. Furthermore, the end user has to know which type of HID bulb he needs, and must then be able to attach or detach the metal frame, depending on his headlamp type. However, in this alternative solution, the metal shield cannot block unwanted light as effectively as pinstripes applied directly onto the lamp, and mounting or construction errors detract further from the quality of the resulting front beam.

Therefore, it is an object of the invention to provide an alternative HID lamp design that overcomes the problems mentioned above.

SUMMARY OF THE INVENTION

The object of the invention is achieved by the gas-discharge lamp of claim 1.

According to the invention, the gas-discharge lamp comprises an inner vessel enclosing a pair of electrodes separated by a gap; and an outer vessel enclosing the inner vessel; and wherein the lamp comprises a lateral stripe arranged on the surface of a vessel such that the lateral stripe lies below a horizontal plane through a longitudinal axis through the center of the lamp, and wherein the lateral stripe extends essentially only over a region corresponding to the gap between the electrodes.

In the context of the invention, the expression "extending essentially only over a region corresponding to the gap between the electrodes" is to be understood that the lateral stripe is applied only over a portion of the vessel that is in a "line of sight" with the gap between the electrodes. In other words, the lateral stripe will essentially only obscure the gap when the lamp is viewed from the side.

In the context of the invention the expression "horizontal plane through the longitudinal axis" corresponds to the horizontal plane through the longitudinal axis of the discharge lamp in mounted position of the discharge lamp, in particular mounted in a vehicle headlamp. This mounting position is pre-determined by the standardized mechanical and/or electrical connection of the discharge lamp and the vehicle headlamp.

An advantage of the gas-discharge lamp according to the invention is that it can be used in both R-type and S-type headlamps, i.e. in both reflector headlamps and projector headlamps without the need of the end used to adapt the HID bulb with respect to the type of his headlamp. Therefore, the driver of an automobile with projector headlamps could replace a defective D2S lamp by a lamp according to the invention. Equally, the driver of an automobile with reflector headlamps could replace a defective D4R lamp by a lamp according to the invention. The HID bulb according to the invention presents a considerable simplification to manufacturers, retailers and consumers regarding the aftermarket business. Instead of having to manufacture, distribute and choose from a multitude of different Xenon HID bulb types, a single Xenon HID bulb type can suffice. This presents a significant cost saving to the manufacturer and also to the distributors, and the customer can more easily identify a suitable HID bulb to replace a defective one.

The dependent claims and the following description disclose particularly advantageous embodiments and features of the invention. Features of the embodiments may be combined as appropriate. Features described in the context of one claim category can apply equally to another claim category.

In the context of the invention, the terms "gas-discharge bulb", "HID bulb" and "Xenon HID bulb" are to be understood to have the same meaning, and these terms may be used interchangeably. The terms "lamp" and "bulb" may also be used interchangeably. Preferably, the lamp according to the invention is free of any other coating, specifically free of any coating or stripe about an inner end region, i.e. about the circumference of the lamp near the base or ballast. This absence of any other coated regions distinguishes such a preferred embodiment of the inventive lamp from any prior art R-type lamp that makes use of horizontal as well as circumferential/vertical stripes to define a bright/dark cut-off line of the front beam. Such coatings are generally applied as narrow stripes of an opaque material, and are commonly referred to as "pinstripes". In the following, the terms "strip", "stripe", "coating" and "pinstripe" have the same meaning and may be used interchangeably.

As mentioned above, the lateral stripe is applied on the surface of a vessel of the lamp so that, at most, it only obscures the gap between the electrodes when the lamp is viewed from the side. In a Xenon HID lamp, the gap between the electrodes generally only comprises about 4-5 mm. Therefore, in a preferred embodiment of the invention, the lateral stripe has a length that preferably does not exceed the length of the gap between the electrodes.

While the lateral stripe is applied across the vessel in the region corresponding to the gap between the electrodes, in order to achieve the effects mentioned above, the height of the lateral stripe is preferably chosen to block as little light as possible. Therefore, in a preferred embodiment of the invention, the lateral stripe has a height of at most 2.1 mm, preferably at most 1.3 mm. The radial position of a lateral stripe—i.e. its position relative to a horizontal plane through the lamp's central axis—is preferably the same as the radial position of a corresponding lateral stripe on a standard or prior art R-type Xenon HID lamp.

Since the purpose of the lateral stripe is to block light from appearing above the bright/dark cut-off line of the front beam, an opaque material is preferably used to form the lateral stripe. Preferably, the material used to form the lateral stripe is also heat-resistant.

In a reflector lamp or projector lamp, the lamp optics serve to collect as much light as possible, shape it to achieve a desired front beam shape, and cast the front beam outwards from the headlamp. The bright/dark cut-off line is a critical characteristic of a front beam. Very little light—preferably none at all—should stray above the cut-off line, in order to limit glare for oncoming traffic. Therefore, in a further preferred embodiment of the invention, the lamp comprises two lateral stripes, one on each side of the vessel. This design facilitates generation of a clear cut-off line across the width of the front beam. Preferably, the two lateral stripes have essentially identical dimensions, and the radial position of both lateral stripes on the lamp (i.e. their positions relative to a horizontal plane through the center of the lamp) preferably corresponds to the radial position of lateral pinstripes on a standard R-type Xenon HID lamp.

Since the front beam is essentially "composed" of many images of the discharge arc cast outward from the lamp (in the case of a reflector lamp), the lateral stripe is preferably slightly longer than a region corresponding to the length of the electrode gap. This helps to ensure a sharp cut-off line, even if the electrode tip should burn back over time, with the result that the electrode shortens and the gap lengthens. Additionally, axial position tolerances of both electrode tips on the order of +/−0.2 mm should be taken into account. The longitudinal stripe extends by a distance of at most 2.0 mm, preferably 1.5 mm, and most preferably at most 1.0 mm, in the direction of an outer end region of the lamp, since the light emitted into the corresponding solid angle of the Xenon HID lamp is directed into area of the glare zone area close to the central position of the cut-off line, corresponding to a region in the line of sight of an oncoming driver.

Preferably, the lamp according to the invention is designed for a nominal power of 35 W. For such an HID Xenon lamp, the capacity of the inner discharge vessel or burner is preferably greater than or equal to 15 μl and less than or equal to 23 μl. Preferably, the inner diameter of the burner comprises at least 2.2 mm and at most 2.8 mm; and the outer diameter of the burner comprises at least 5.2 mm and at most 5.8 mm.

The lateral stripe can be applied to an inside surface and/or an outside surface of a vessel. For example, lateral stripes can be applied on either side of the burner on its outside surface. However, since the burner becomes very hot during operation, the material of the lateral stripe would have to be extremely heat-resistant. Therefore, in a preferred embodiment of the invention, the lateral stripe is applied to an outer surface of the outer vessel or envelope.

In a further embodiment of the lamp according to the invention, an additional narrow circumferential strip is applied at the inner end of the lamp, i.e. at the end of the lamp closest to the housing. The edge of the circumferential strip that is closest to the discharge arc preferably corresponds to the edge of the circumferential strip as specified for an R-type Xenon HID lamp. The width of the circumferential strip is preferably at most 4.0 mm, most preferably at most 2.0 mm. The circumferential strip is separate from the lateral strip, so that the relevant edges of the circumferential and lateral strips are separated by at least 1.0 mm. The circumferential strip significantly reduces the glare well above the bright/dark cut-off line. This region mainly corresponds to glare perceived by oncoming traffic at a distance of 20-100 m in front of the vehicle. Even though this embodiment makes use of a circumferential strip in addition to the lateral strip, this lamp can still be used in an S-type headlamp since the circumferential pinstripe is far behind the first electrode and thus has only a very weak impact on the light distribution of an S-type headlamp beam pattern. On the other hand, the additional narrow circumferential pinstripe slightly increases the temperature of the inner discharge vessel and thus improves the efficiency of the HID bulb, resulting in a brighter light output. The improved efficiency can therefore compensate for any light losses due to the "shadowing" effect of the pinstripes.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
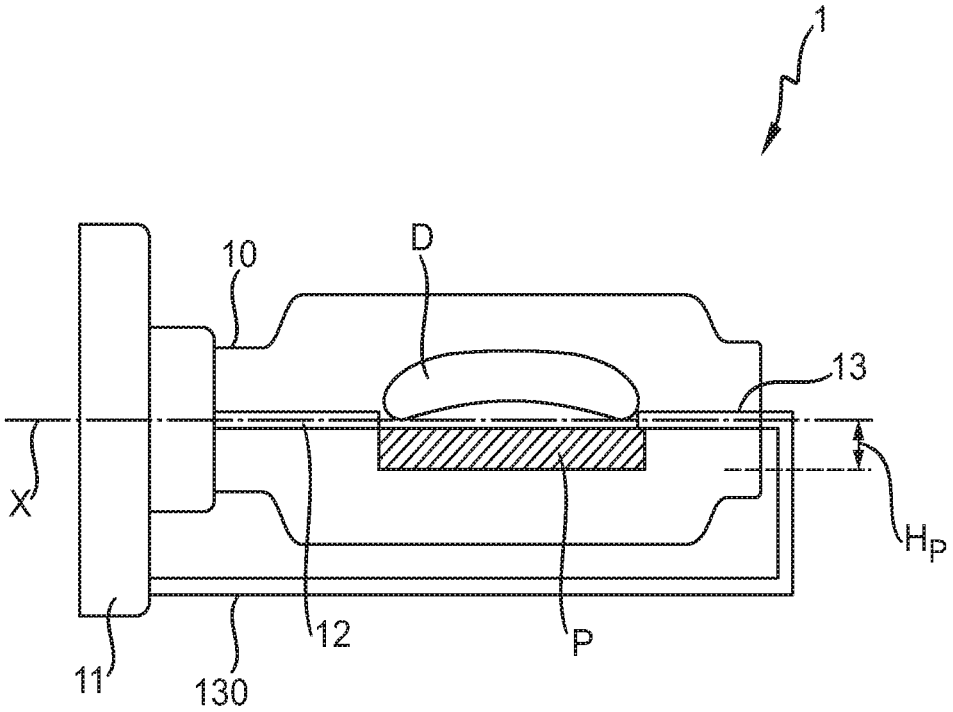
FIG. 1 shows a high-intensity discharge lamp according to a first embodiment of the invention.

FIG. 1 shows a HID lamp 1 according to an embodiment of the invention. The lamp 1 comprises an outer vessel 10 or envelope 10 enclosing an inner vessel 100 or burner 100. Two electrodes 12, 13 extend into the burner 100 and their tips face each other across a narrow gap G. A return lead 130 provides an electrical connection between the outer electrode 13 and a base 11 or ballast housing 11 of the lamp 1, so that both electrodes 12, 13 can be electrically connected to a ballast (not shown). The geometrical construction details of this lamp 1 correspond essentially to those of a standard D2R lamp. When the lamp 1 is ignited, a discharge arc D is established between the electrode tips. The discharge arc D will have a curved bow shape extending above a longitudinal axis X extending through the center of the lamp 1. The diagram shows a lateral stripe P applied to an outer surface of the envelope 10. The stripe P is arranged such that it does not extend above the level of the longitudinal axis X, i.e. the stripe P lies below a horizontal plane through the center of the lamp 1. The height $H_P$ of the lateral stripe P is in the range 2.0 mm±0.7 mm, i.e. at least 1.3 mm and at most 2.7 mm, in keeping with the specification. However, in the lamp 1 according to the invention, the lateral stripe P is wide enough to just cover a region corresponding to the gap G between the electrodes 12, 13, with at most a slight overlap into the regions beyond the electrode tips. On account of this design, the lamp 1 according to the invention can be used in both R-type and S-type headlamps in countries that allow a deviation from the applicable regulations.

Figure 2:
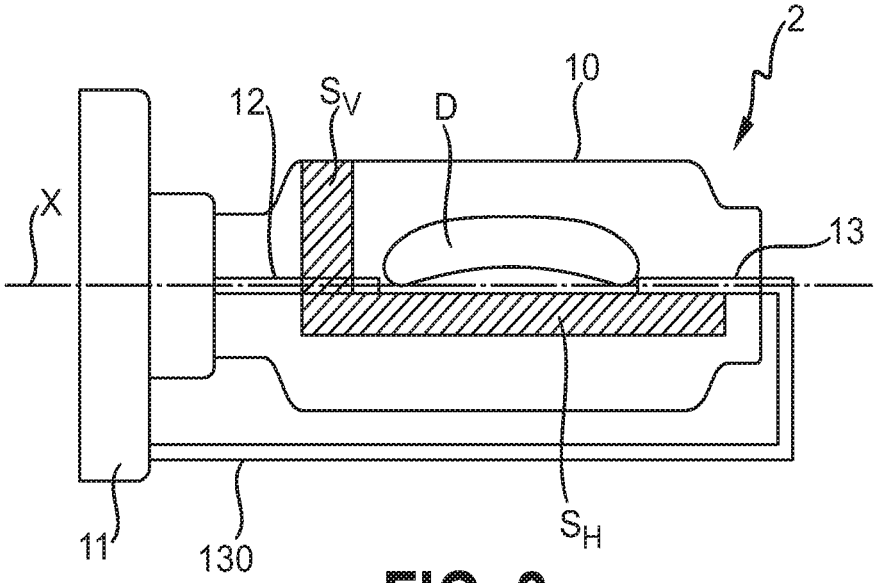
FIG. 2 (prior art)
FIG. 2 shows a prior art R-type high-intensity discharge lamp.

For comparison, FIG. 2 shows a prior art D4R R-type lamp 2. However, this known type of lamp 2 makes use of two types of stripe $S_H$, $S_V$ applied to the outer vessel 10. A horizontal stripe $S_H$ serves to achieve a desired bright/dark cut-off, while a vertical stripe $S_V$, applied around the outer vessel 10 in the region near to the lamp base 11, serves to reduce glare above the cut-off line. Because of the significant manipulation of the beam that is the result of these stripes $S_H$, $S_V$, this type of bulb 2 may only be used in an R-type headlamp. A front beam generated by this lamp 2, when used in a projector headlamp, would be severely deficient.

Figure 3A:
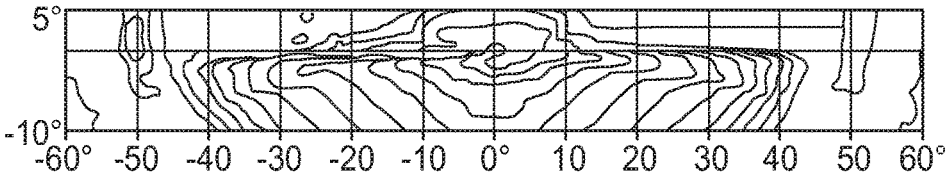
FIG. 3A shows a front beam generated by the lamp according to the invention used in a projector headlamp.
Figure 3B:
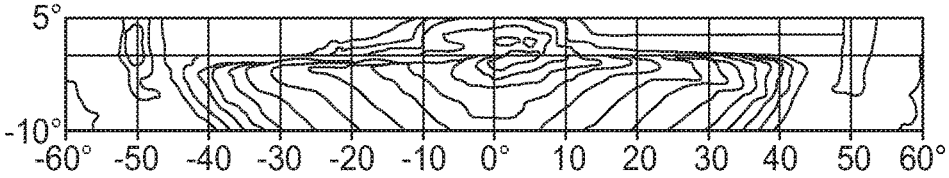
FIG. 3B shows a front beam generated by a prior art lamp used in a projector headlamp.

FIG. 3A shows a front beam, generated by the lamp of FIG. 1 installed in a projector headlamp, and cast onto a screen at 25 m. The screen extends from −60° to +60° along the X-axis, and from −10° to +5° along the Y-axis. FIG. 3B shows a front beam generated by a conventional S-type HID lamp installed in the same type of projector headlamp, also cast onto a screen at 25 m over the same angular range as in FIG. 3A. The diagrams illustrate that there is negligible difference between the two beam profiles. Even though the lamp of FIG. 1 bears lateral stripes, its performance is comparable to the conventional S-type lamp, which does not have any stripes at all. This may be explained by the physical effect of the lateral stripe, which raises the burner temperature. Therefore, even though the lateral stripes effectively block some of the light from the discharge arc, the increase in burner temperature results in a brighter discharge arc. The result is a beam profile that deviates at most only slightly from the beam profile achieved by the standard S-type lamp.

Figure 4A:
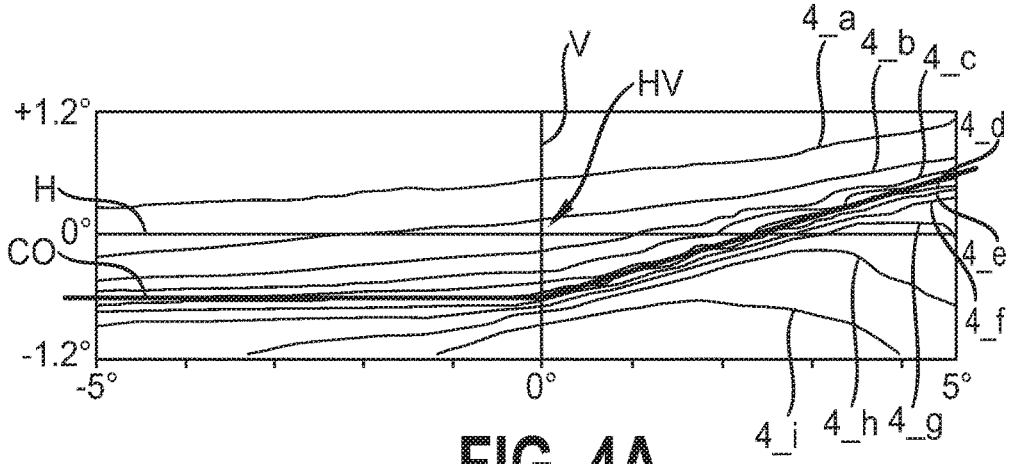
FIG. 4A shows a shoulder region of a beam profile achieved by a prior art lamp of type D4R used in a reflector headlamp.
Figure 4B:
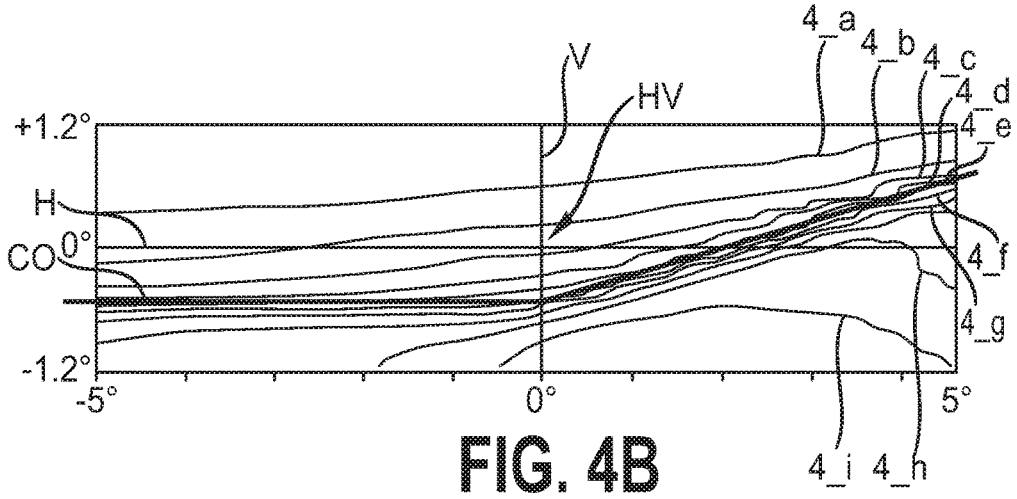
FIG. 4B shows a shoulder region of a beam profile achieved by a lamp according to the invention used in the same type of reflector headlamp.
Figure 4C:
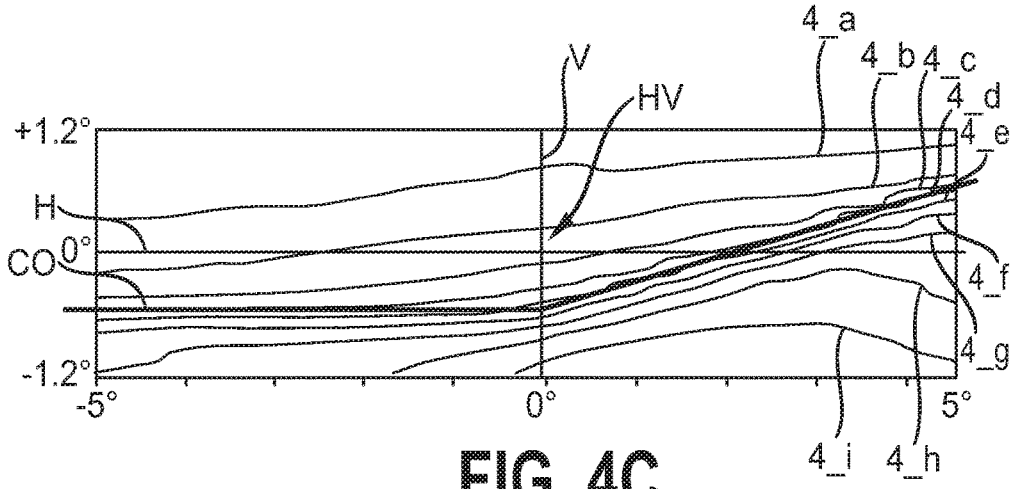
FIG. 4C shows a shoulder region of a beam profile achieved by a prior art lamp with a detachable metal frame used in the same type of reflector headlamp.

FIGS. 4A-4C show the most critical region in the beam profile of a reflector headlamp (at 25-100 m in front of a vehicle, covering an angular range of −5° to +5° along the X-axis, and −1.2° to +1.2° along the Y-axis) as achieved by a standard D4R lamp used in a reflector headlamp (FIG. 4A); for the lamp according to the invention used in the same type of reflector headlamp (FIG. 4B); and for a HID lamp with an detachable metal frame, also used in the same type of reflector headlamp (FIG. 4C). The region shown in the diagrams corresponds to the "shoulder" region of the bright/dark cut-off line CO. A relevant measurement point HV is given by the intersection of the horizontal line H and vertical line V that divide the projection into four quadrants. Each diagram shows nine ISO candela lines 4_*a*, 4_*b*, . . . , 4_*i* indicating regions of luminous intensity, with values of 400; 630; 1,000; 1,600; 2500 cd; 4,000; 6,300; 16,000; and 25,000 cd respectively. It is important that the front beam is not corrupted by stray light above the cut-off line, particularly in the "shoulder region" in the upper left corner of the lower right quadrant. FIG. 4A shows that the conventional D4R lamp satisfies the front beam requirements, with a favorably high level of luminous intensity at a distance of 70-80 m outward from the headlamp, as indicated by the lowest contour line 4_*i* corresponding to 25,000 cd. Glare levels of 625 cd at the intersection of the horizontal and vertical line were measured for this lamp. Here, the contour lines 4_*c*-4_*g* in the range of 1,000-6,300 cd are closely grouped, indicating a favorably abrupt transition between "dark" (above the cut-off line CO) and "bright" (below the cut-off line). FIG. 4B shows that the lamp according to the invention—even though it only has shorter lateral stripes and no circumferential stripe—still produces a satisfactory beam profile. In this case, favorably low glare levels of only around 700 cd were measured, as indicated by the closely grouped contour lines 4_*c*-4_*g* (similar to FIG. 4A). Here also, the front beam is characterized by a favorably high level of luminous intensity at a distance of 70-80 m outward from the headlamp, as indicated by the lowest contour line 4_*i* corresponding to 25,000 cd. The diagrams illustrate that the lamp according to the invention can be used in an R-type headlamp since it provides a beam profile similar to a standard D4R lamp, and is characterized by a glare level that is significantly below the glare level achieved by a prior art Xenon HID lamp with detachable metal frame, as illustrated in FIG. 4C, which shows that the alternative solution (with such a metal frame) fails to deliver a satisfactory front beam. The detachable metal frame is too far away from the discharge arc to be able to achieve a sharp cut-off. Here, the contour lines 4_*c*-4_*g* are relatively wide apart, indicating an unfavorable transition between "dark" and "bright" about the cut-off line CO. This results in a significantly lower illumination close to the cut-off line far in front of the vehicle (at a distance of 40-80 m). Additionally stray light due to the reflections from the metal frame is scattered which increases the light intensity at the measurement point HV to a level of 1500 cd, which is significantly higher compared to what is achieved by the inventive lamp.

Figure 5:
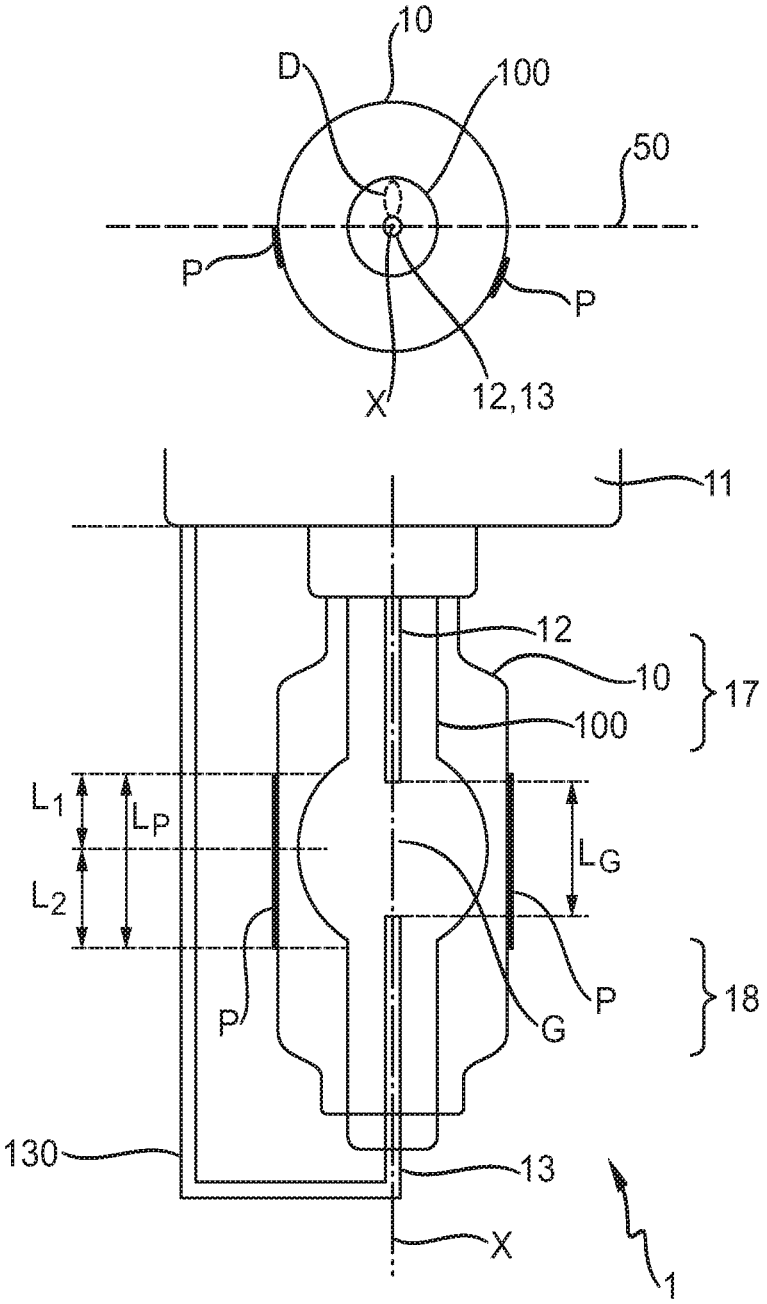
FIG. 5 shows further views of an embodiment of the lamp according to the invention.

FIG. 5 shows further views of the lamp according to the invention, showing a cross-section taken through a vertical plane (upper part of the diagram) and a cross-section through a horizontal plane (lower part of the diagram). The diagrams show the burner 100 enclosed by the outer vessel 10 or envelope 10, and a longitudinal axis X extending through the electrodes 12, 13 and the center of the lamp 1. The diameter of the outer vessel is about 8.7 mm in the case of a 35 W lamp constructed according to the D4R specifications. The position of the lateral stripes P on each side of the lamp 1 is shown relative to a horizontal plane 50 through the center of the lamp 10. In the lower part of the diagram, the electrodes 12, 13 are shown to be separated by a gap G, which has a gap length $L_G$ of about 4.2 mm. The lateral stripes P are shown to be applied in a region corresponding to the gap G, and to extend by small amounts towards an outer region 18 at the "front" of the lamp 10 (i.e., facing outward from the headlamp arrangement) and towards an inner region 17 towards the base 11 or ballast housing of the lamp 10, so that the lateral stripe P has an overall length $L_P$. A lateral stripe P extends slightly further towards the outer region 18 of the lamp 10 than towards the inner region 17, so that the lateral stripe P is "offset" from the gap G. Taking the center of the gap G as a reference point, the lateral stripe P comprises a first portion with length $L_1$ extending towards and beyond a point corresponding to the cathode tip, and a second portion with length $L_2$ extending towards and beyond a point corresponding to the anode tip. As explained above, the effect of applying the lateral stripe P in this way is to ensure that the lateral stripe P always extends along the entire length of the discharge arc, in case the arc lengthens due to burnback, and/taking into account positioning tolerances of the electrodes 12, 13.

Figure 6:
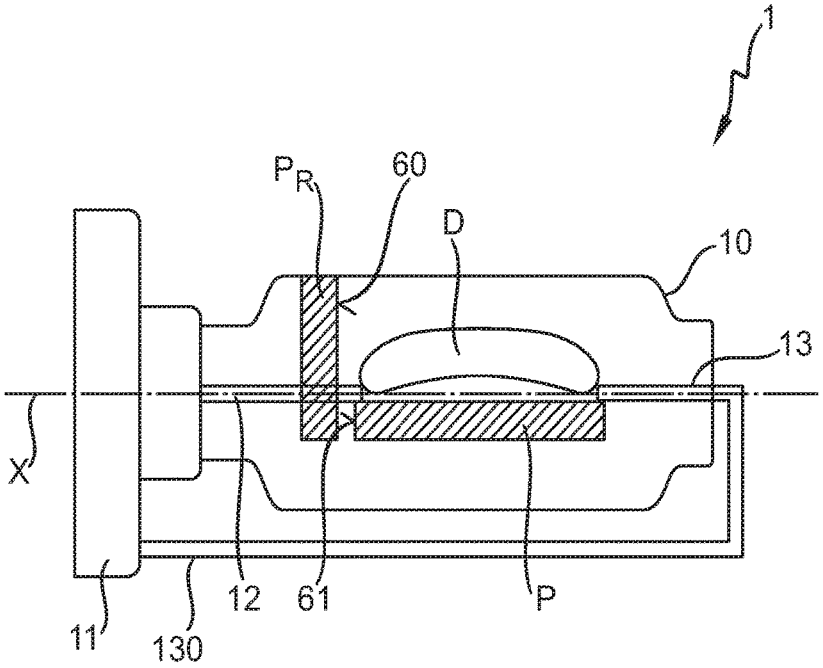
FIG. 6 shows another preferred embodiment of a lamp according to the invention with a circumferential stripe in the inner region of the lamp.

Another preferred embodiment is achieved by adding a 2-4 mm circumferential stripe $P_R$ in the inner region close to the base of the lamp 1 as shown in FIG. 6. The inner edge 60 of the circumferential stripe $P_R$ corresponds to the position of the inner edge of a circumferential coating on a standard D4R lamp. The "inner" edge 60 of the circumferential stripe $P_R$ (i.e. the edge closest to the discharge arc) is separated from the corresponding short edge 61 of the lateral strip P by a distance of about 2 mm. In the lamp according to the invention, the circumferential stripe $P_R$ reduces the glare experienced by oncoming drivers approaching at a distance of 20-100 m by a factor of two.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A gas-discharge lamp for horizontal mounting in a vehicle headlamp comprising:

an inner vessel enclosing a pair of electrodes separated by a gap; and an outer vessel enclosing the inner vessel;

wherein the lamp comprises a lateral stripe for blocking light of the lamp from appearing above a bright/dark cut-off line of a front beam of the vehicle headlamp, with the lateral stripe being arranged on a surface of the inner or outer vessel below a horizontal plane through a longitudinal axis through the center of the lamp, and wherein the lateral stripe extends over a region corresponding to the gap between the electrodes, and by a distance of at most 1.0 mm beyond the gap in the direction of an inner end region of the lamp, and by a distance of at most 2.0 mm beyond the gap in the direction of an outer end region of the lamp.

2. A lamp according to claim 1, wherein the lateral stripe has a length of at most 6.0 mm, preferably at most 5.0 mm.

3. A lamp according to claim 1, wherein the lateral stripe has a height of 2.0±0.7 mm.

4. A lamp according to claim 1, wherein the lamp comprises two lateral stripes, one on each side of the inner or outer vessel.

5. A lamp according to claim 4, wherein the lateral stripes have essentially identical dimensions.

6. A lamp according to claim 1, wherein the lateral stripe extends by a distance of at most 0.5 mm in the direction of the inner end region of the lamp.

7. A lamp according to claim 1, wherein the lateral stripe extends by a distance of at most 0.5 mm in the direction of the outer end region of the lamp.

8. A lamp according to claim 1, wherein the lateral stripe comprises an opaque material.

9. A lamp according to claim 1, wherein the lamp is free of any coating about the inner end region.

10. A lamp according to claim 1, further comprising a circumferential stripe arranged on a surface of the inner or outer vessel in the inner region of the lamp, and wherein the circumferential stripe is separate from the lateral stripe by a distance of at least 1.5 mm.

11. A lamp according to claim 1, with a nominal power of 35 W, for which lamp the capacity of the inner discharge vessel is greater than or equal to 15 μl and less than or equal to 23 μl;

the inner diameter of the inner discharge vessel comprises at least 2.2 mm and at most 2.8 mm; and the outer diameter of the inner discharge vessel comprises at least 5.2 mm and at most 5.8 mm.

12. A lamp according to claim 1, wherein the lateral stripe is applied to an outer surface of the outer vessel of the lamp.

* * * * *